US007238903B2

(12) United States Patent
Fischer

(10) Patent No.: US 7,238,903 B2
(45) Date of Patent: Jul. 3, 2007

(54) ELECTRICAL SWITCHING APPARATUS OPERATING MECHANISM WITH OPERATING MEMBER THEREFOR, AND ENCLOSURE ASSEMBLY EMPLOYING THE SAME

(75) Inventor: Kenneth M. Fischer, Finleyville, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/264,906

(22) Filed: Nov. 2, 2005

(65) Prior Publication Data

US 2007/0095640 A1 May 3, 2007

(51) Int. Cl.
*H01H 3/20* (2006.01)

(52) U.S. Cl. ..... 200/330; 200/335

(58) Field of Classification Search ..... 200/318–327, 200/329–332.2, 335–337, 339, 43.01
See application file for complete search history.

(56) References Cited

U.S. PATENT DOCUMENTS 4,118,608 A * 10/1978 Kussy et al. ..... 200/56 R
4,517,422 A * 5/1985 Black et al. ..... 200/50.37
5,034,581 A * 7/1991 Bruels ..... 200/81.4
5,219,070 A 6/1993 Grunert et al.
5,288,958 A 2/1994 Grunert et al.
5,486,668 A * 1/1996 Erickson ..... 200/400
5,493,084 A * 2/1996 Whitaker et al. ..... 200/50.05
6,194,983 B1 2/2001 Bogdon et al.
6,423,912 B1 7/2002 Arenz et al.
6,596,952 B1 7/2003 Degrazia et al.
6,797,903 B1 * 9/2004 Winslett et al. ..... 200/331
6,974,922 B2 * 12/2005 Bortolloni et al. ..... 200/50.06

* cited by examiner

*Primary Examiner*—Michael A. Friedhofer
*Assistant Examiner*—Lisa Klaus
(74) *Attorney, Agent, or Firm*—Martin J. Moran

(57) ABSTRACT

An operating mechanism is for a circuit breaker housed by an enclosure assembly including a panel movable between a closed position and an open position. The operating mechanism includes a linkage and an operating member. The operating mechanism is coupled to the handle of the circuit breaker to provide operation of the handle from the exterior of the enclosure when the panel is closed. The operating member includes a first end having an engaging portion coupled to the linkage of the operating mechanism, and a second end structured for gripping by a user. The operating member enables the handle of the circuit breaker to be operated, without requiring the use of separate hand tools, when the panel of the enclosure is open and the handle portion of the operating member is actuated.

14 Claims, 2 Drawing Sheets

ELECTRICAL SWITCHING APPARATUS OPERATING MECHANISM WITH OPERATING MEMBER THEREFOR, AND ENCLOSURE ASSEMBLY EMPLOYING THE SAME

BACKGROUND OF THE INVENTION

1. Field of the Invention

The present invention relates generally to electrical switching apparatus and, more particularly, to an electrical switching apparatus operating mechanism with an operating member therefor. The invention also relates to an enclosure assembly employing an operating mechanism with an operating member.

2. Background Information

For a variety of reasons, such as, for example and without limitation, operator safety and to prevent unauthorized access, electrical switching apparatus, such as molded case circuit breakers, are often mounted behind a panel or housed with an enclosure (e.g., without limitation, panelboard; load center; switchgear cabinet).

FIG. 1 shows an example of one such installation wherein the circuit breaker handle 4 is not directly accessible by the operator. Specifically, the circuit breaker 2 is installed inside an enclosure 6 having a door 8, with the circuit breaker handle 4 being suitably located behind the door 8. In the example of FIG. 1, an operating mechanism 10, which includes a rotary handle 12 mounted on the exterior of the door 8, is employed. A mechanical linkage 14 is used to interconnect the rotary handle 12 with a pivot mechanism 16 inside the enclosure 6. The pivot mechanism 16 drives a sliding mechanism 18 which moves the circuit breaker handle 4 between the operating positions (e.g., ON; OFF; reset) thereof. See, e.g., U.S. Pat. No. 5,493,084 which is hereby incorporated herein by reference.

When the enclosure 6 is open, for example during maintenance of the circuit breaker 2, the rotary handle 12 is disengaged from the linkage 14. Hence, the rotary handle 12, and thus the circuit breaker handle 4, cannot be actuated absent the use of one or more separate hand tools (e.g., without limitation, wrenches; pliers; vice-grips; pipe clamps; screwdrivers) (not shown). Such tools are required, for example, to grasp the mechanical linkage 14 and/or pivot mechanism 16 in order to drive the sliding mechanism 18 and move the circuit breaker handle 4.

There is a need, therefore, for a device to operate the circuit breaker even when the enclosure door is open. There is a further need for a device for operating the circuit breaker without requiring the use of separate independent hand tools when the enclosure door is open.

Accordingly, there is room for improvement in operating mechanisms for circuit breakers, and in enclosure assemblies employing operating mechanisms.

SUMMARY OF THE INVENTION

These needs and others are met by the present invention, which is directed to an operating member for actuating an operating mechanism coupled to the handle of an electrical switching apparatus.

As one aspect of the invention, an operating mechanism is provided for an electrical switching apparatus housed by an enclosure. The enclosure includes a panel movable between a closed position and an open position in order to provide access to the electrical switching apparatus. The electrical switching apparatus includes a handle. The operating mechanism comprises: a linkage structured to be coupled to the handle of the electrical switching apparatus and to provide operation of the handle from the exterior of the enclosure when the panel is closed; and an operating member including a first end and a second end, the first end of the operating member having an engaging portion coupled to the linkage of the operating mechanism when the panel is disposed in the closed position and the open position, the second end of the operating member having a handle portion structured for gripping by a user. When the panel of the enclosure is disposed in the open position and the handle portion of the operating member is actuated, the engaging portion of the operating member moves the linkage thereby operating the handle of the electrical switching apparatus.

The engaging portion of the first end of the operating member may include an aperture which is structured to engage the linkage of the operating mechanism. The linkage of the operating mechanism may have a generally square cross-section and the aperture of the engaging portion may have a generally square shape corresponding to the generally square cross-section of the linkage.

The handle portion of the second end of the operating member may include a grip. The grip may comprise a cover made from an electrically insulating material, such as vinyl. The operating member may be made from a metallic material and may comprise a generally flat sheet metal stamping.

As another aspect of the invention, an enclosure assembly comprises: an enclosure including a back panel, first and second side walls extending from the back panel, a top end, a bottom end, and a front panel; an electrical switching apparatus housed by the enclosure and including a handle; and an operating mechanism coupled to the handle of the electrical switching apparatus, the operating mechanism comprising: a linkage extending through the front panel of the enclosure in order to operate the operating mechanism and the handle from the exterior of the enclosure, and an operating member including a first end and a second end, the first end of the operating member having an engaging portion which engages the linkage within the enclosure when the front panel is open and when the front panel is closed, the second end of the operating member having a handle portion for gripping by a user, wherein when the front panel of the enclosure is open, the operating member is movable in order to move the linkage of the operating mechanism and thereby operate the handle of the electrical switching apparatus.

The enclosure may include as the front panel, a door which is pivotable between an open position and a closed position, the electrical switching apparatus may be a circuit breaker, and the operating mechanism may further comprise a rotary handle disposed on the exterior of the door in order to actuate the operating mechanism and the handle of the circuit breaker when the door is closed. The operating member provides operation of the operating mechanism when the door is open.

The operating mechanism may further comprise a maintaining mechanism for maintaining the position of the operating member on the linkage of the operating mechanism. The engaging portion of the operating member may include an aperture structured to receive the linkage of the operating mechanism wherein the maintaining mechanism comprises a plurality of retainers disposed on the linkage on both sides of the engaging portion of the operating member coupled thereto. The retainers may comprise a pair of O-rings wherein one O-ring is disposed adjacent one side of the engaging portion of the operating member and the other O-ring is disposed adjacent the opposite side of the engaging portion of the operating member.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
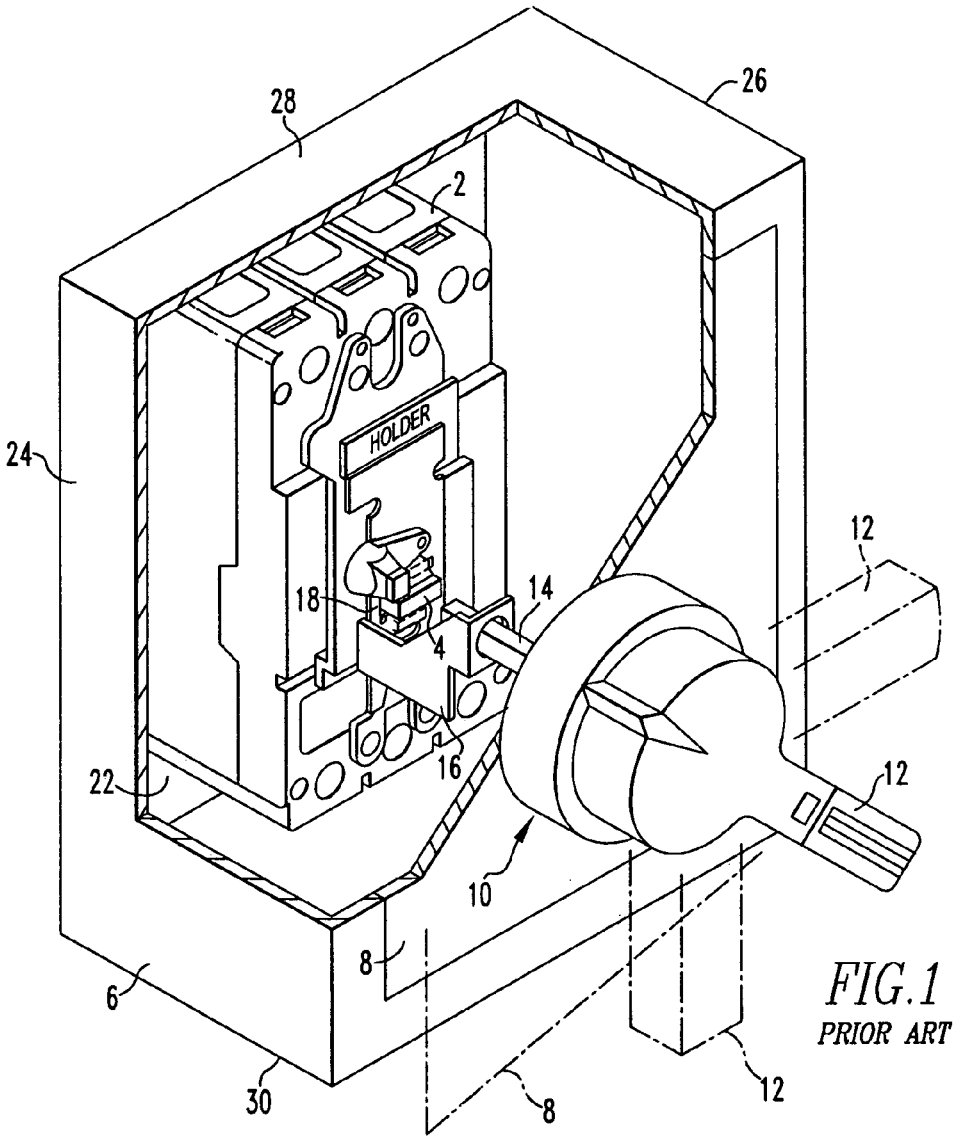
FIG.1 PRIOR ART
FIG. 1 is an isometric view of an enclosure housing a circuit breaker, and an operating mechanism therefor, with a portion of the enclosure cut-away to show the operating mechanism which includes a rotary handle for operating the circuit breaker handle from the exterior of the enclosure.

Directional phrases used herein, such as, for example, top, bottom, front, back, upper, lower, clockwise, counterclockwise and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

As employed herein, the term "enclosure" refers to any suitable structure for housing an electrical switching apparatus (e.g., without limitation, circuit switching devices and circuit interrupters such as circuit breakers, contactors, motor starters, motor controllers and other load controllers) and expressly includes, without limitation, panelboards, load centers and switchgear cabinets, as well as other structures or compartments which are covered with a panel, such as, for example and without limitation, in a prepared opening in the wall of a building, in a piece of machinery, or in a vehicle.

As employed herein, the term "maintaining mechanism" refers to any suitable device which is usable either individually or in a quantity greater than one (i.e., a plurality) in order to maintain the position of one component in relation to another component and expressly includes, without limitation, an O-ring.

As employed herein, the term "linkage" refers to any known or suitable mechanism for interconnecting one component to another component in order to provide mechanical communication therebetween and expressly includes, without limitation, a rigid member, such as a tube, a rod, a shaft, or a link, as well as combinations of a rigid member with a flexible member, such as a cable, a wire, a chain, and an interconnected link.

Figure 2:
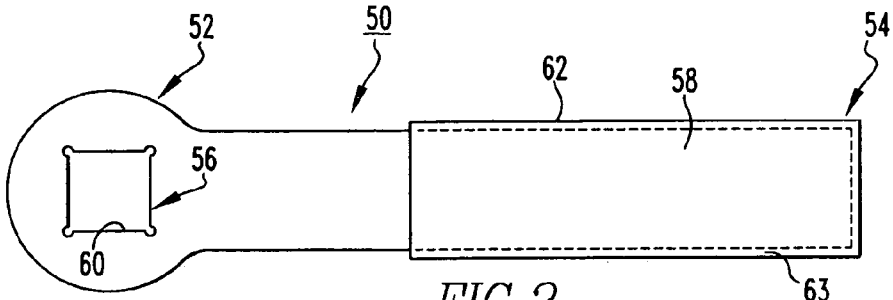
FIG. 2 is a vertical elevational view of an operating member for use with the operating mechanism of FIG. 1 in accordance with the invention.
Figure 3:
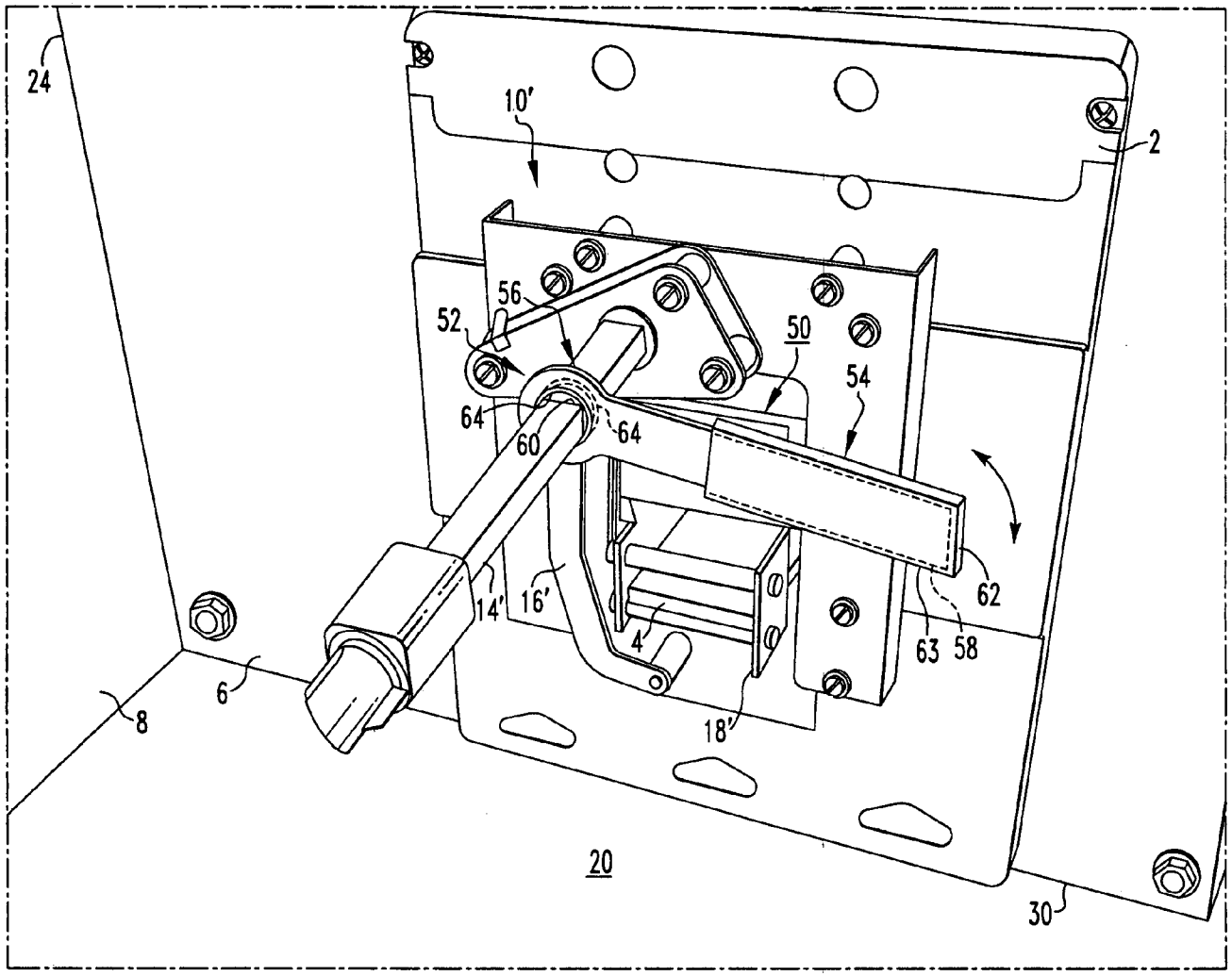
FIG. 3 is an isometric view of the operating member of FIG. 2 employed to operate the operating mechanism of FIG. 1 while the door of the enclosure is open.

FIGS. 2 and 3 show an operating member 50 for the operating mechanism 10' (FIG. 3) of an enclosure assembly 20 (FIG. 3), in accordance with the invention. The enclosure assembly 20 includes an enclosure 6 (e.g., without limitation, panelboard; load center; switchgear cabinet) (partially shown in FIG. 3). The enclosure 6, as best shown in FIG. 1, includes a back panel 22, first and second sidewalls 24, 26 extending from the back panel 22, a top end 28, a bottom end 30, and a front panel, such as the exemplary door 8. An electrical switching apparatus 2, such as the circuit breaker 2 shown, includes a handle 4 and is housed by the enclosure 6. The operating mechanism 10 (FIG. 1), 10' (FIG. 3) is coupled to the handle 4 and includes a linkage 14 (FIG. 1), 14' (FIG. 3) which, when the door 8 is closed, extends through the door 8 and connects to an operating handle, such as the rotary handle 12, shown in FIG. 1. In this manner, the operating mechanism 10, 10' and thus the circuit breaker 2 can be operated from the exterior of the enclosure 6 when the door 8 is closed.

However, prior to the invention, when the door 8 is open, as shown in FIG. 3, the rotary handle 12 is disengaged from the linkage 14, and one or more separate hand tools (not shown) were required in order to actuate the operating mechanism 10. More specifically, like operating mechanism 10 previously discussed in connection with FIG. 1, operating mechanism 10' in the example of FIG. 3 includes pivot mechanism 16' and sliding mechanism 18', which are coupled to the circuit breaker 2, as shown. The linkage, which in the example of FIG. 3 comprises a shaft 14' having a generally square cross-section, is coupled to the pivot mechanism 16'. Accordingly, when the door 8 of the enclosure 6 is open, one or both of linkage 14' and pivot mechanism 16' had to be engaged and actuated in order to drive the sliding mechanism 18' and, in turn, operate the circuit breaker handle 4. In other words, the linkage 14' extends through the door 8 and connects with rotary handle 12 (FIG. 1) when the door 8 is disposed in the closed position (FIG. 1) but, when the door 8 is open as shown in FIG. 3, and use of the rotary handle 12 (FIG. 1) is not available, separate hand tools (not shown) were required to operate the circuit breaker 2. The invention overcomes this disadvantage by providing the operating member 50 which is structured to enable operation of the operating mechanism 10' and thus handle 4 of the circuit breaker 2 when the enclosure door 8 is opened.

As shown in FIGS. 2 and 3, the operating member 50 includes a first end 52 and a second end 54. The first end 52 has an engaging portion 56 which is structured to be coupled to linkage 14' of the operating mechanism 10', as best shown in FIG. 3. The second end 54 of the operating member 50 includes a handle portion 58 structured for gripping by a user. Accordingly, when the door 8 of the enclosure 6 is disposed in the open position, as shown in FIG. 3, and the handle portion 58 of the operating member 50 is actuated (e.g., moved clockwise or counterclockwise from the perspective to FIG. 3), the engaging portion 56 of the operating member 50 moves linkage 14' thus pivoting pivot mechanism 16' and driving sliding mechanism 18' of the operating mechanism 10' which in turn operates the handle 4 of the circuit breaker 2.

More specifically, the engaging portion 56 of the first end 52 of the operating member 50 includes an aperture 60 which is structured to engage linkage 14' of the operating mechanism 10'. As previously discussed, the exemplary linkage 14' has a generally square cross-section. As best shown in FIG. 2, the aperture 60 of the engaging portion 56 has a generally square shape corresponding to the generally square cross-section of linkage 14'. It will, however, be appreciated that any alternative suitable engaging portion configuration other than the exemplary generally square aperture 60 could be employed without departing from the scope of the invention. For example, without limitation, the aperture could alternatively consist of a rectangular slot (not shown) structured to receive and engage linkage 14'. It should be noted that the corners of the generally square aperture 60 of the example of FIG. 2 each include a radius.

Such radii serve a number of functions, including improving interaction between operating member 50 and linkage 14' (FIG. 3), for example, by facilitating the ability of the engaging portion 56 of the operating member 50 to slide over and receive linkage 14'. However, it will be appreciated that in other embodiments of the invention (not shown) such radii are not required.

It will still further be appreciated that while the operating member 50 is contemplated as being made from a metallic material such as, for example and without limitation, a generally flat sheet metal stamping as shown in the example of FIGS. 2 and 3, the operating member 50 could alternatively be made from any known or suitable material, and may also be made by any known or suitable production method other than or in addition to stamping.

In the example of FIGS. 2 and 3, the handle portion 58 of the second end 54 of operating member 50 includes a grip 62. The exemplary grip 62 consists of a cover 63 made from an electrically insulating material, such as, for example and without limitation, vinyl. It will, however, be appreciated that any known or suitable alternative material could be employed. The grip 62 serves a number of advantageous purposes. For instance, it functions as a protective cover to resist the possibility of injury to the user caused, for example, by a sharp edge of the stamped metallic operating member 50. It also provides additional gripping capability of the handle portion 58 by the user and, when the grip 62 is made from an electrically insulating material, such as vinyl, it further serves to provide electrical insulation in the event the handle portion 58 contacts a live electrical connection during operation.

As shown in FIG. 3, the exemplary operating mechanism 10' further includes a maintaining mechanism 64 for maintaining the position of the operating member 50 on linkage 14'. In the example of FIG. 3, the maintaining mechanism comprises a plurality of retainers 64 disposed on linkage 14' on both sides of the engaging portion 56 of operating member 50 coupled thereto. Specifically, a pair of O-rings 64 is configured such that one O-ring is disposed adjacent one side of the engaging portion 56 and the other O-ring (shown in hidden line drawing in FIG. 3) is disposed adjacent the opposite side of the engaging portion 56. In this manner, the O-rings 64 serve as stop positions. This is particularly helpful in applications where the enclosure assembly is susceptible to vibration (e.g., without limitation, on a vehicle or a piece of machinery). Vibration could cause the operating member 50 to move with respect to the axis of the linkage 14'. The exemplary O-rings 64 resist such movement by maintaining the operating member 50 in a predetermined stationary position on the linkage 14', within the enclosure 6. It will be appreciated, however, that any known or suitable alternative maintaining mechanism (not shown) other than the exemplary O-rings 64 could be employed. It will also be appreciated that the O-rings 64 or other suitable alternative maintaining mechanism (not shown) could be employed in any suitable number and configuration. It will still further be appreciated that although the exemplary operating member 50 is permanently coupled to the operating mechanism 10' in the embodiment shown and described herein, such permanent installation is not required.

Accordingly, the invention provides an operating member 50 designed to be coupled to the operating mechanism 10' within the enclosure 6 whether the door 8 of the enclosure is open or closed in order to enable quick and easy operation of the operating mechanism 10' and thus the circuit breaker 2 to which it is coupled when the door 8 in which the circuit breaker 2 is housed, is opened. Furthermore, the operating member of the invention is intended, although not required, to remain coupled to the operating mechanism 10' both when the enclosure door 8 is open and when it is closed, in order that such operation may be readily effectuated without requiring the use of separate independent tools.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An enclosure assembly comprising:

an enclosure including a back panel, first and second side walls extending from said back panel, a top end, a bottom end, and a front panel;

an electrical switching apparatus housed by said enclosure and including a handle; and an operating mechanism coupled to said handle of said electrical switching apparatus, said operating mechanism comprising:

a linkage extending through said front panel of said enclosure in order to operate said operating mechanism and said handle from the exterior of said enclosure, and an operating member including a first end and a second end, the first end of said operating member having an engaging portion which engages said linkage within said enclosure, when said front panel is open and when said front panel is closed, the second end of said operating member having a handle portion for gripping by a user, wherein when said front panel of said enclosure is open, said operating member is movable in order to move said linkage of said operating mechanism and thereby operate said handle of said electrical switching apparatus.

2. The enclosure assembly of claim 1 wherein said linkage of said operating mechanism has a cross-sectional shape; wherein said engaging portion of the first end of said operating member includes an aperture; and wherein said aperture has a corresponding shape substantially similar to said cross-sectional shape of said linkage.

3. The enclosure assembly of claim 2 wherein said cross-sectional shape of said linkage and said corresponding shape of said aperture are generally square.

4. The enclosure assembly of claim 1 wherein said handle portion of the second end of said operating member includes a grip.

5. The enclosure assembly of claim 4 wherein said grip comprises a cover made from an electrically insulating material.

6. The enclosure assembly of claim 5 wherein said grip is made from vinyl.

7. The enclosure assembly of claim 1 wherein said operating member is made from a metallic material.

8. The enclosure assembly of claim 7 wherein said operating member comprises a generally flat sheet metal stamping.

9. The enclosure assembly of claim 1 wherein said enclosure includes as said front panel, a door which is pivotable between an open position and a closed position; wherein said electrical switching apparatus is a circuit breaker; wherein said operating mechanism further comprises a rotary handle disposed on the exterior of said door in order to actuate said operating mechanism and said handle of said circuit breaker when said door is closed; and wherein said operating member provides operation of said operating mechanism when said door is open.

10. The enclosure assembly of claim 1 wherein said operating mechanism further comprises a maintaining mechanism for maintaining the position of said operating member on said linkage of said operating mechanism.

11. The enclosure assembly of claim 10 wherein said engaging portion of said operating member includes an aperture structured to receive said linkage of said operating mechanism; and wherein said maintaining mechanism comprises a plurality of retainers disposed on said linkage on both sides of said engaging portion of said operating member coupled thereto.

12. The enclosure assembly of claim 11 wherein said retainers comprise a pair of O-rings; wherein one O-ring of said pair of O-rings is disposed adjacent one side of said engaging portion of said operating member; and wherein the other O-ring of said pair of O-rings is disposed adjacent the opposite side of said engaging portion of said operating member.

13. An operating mechanism for an electrical switching apparatus housed by an enclosure including a panel, said panel being movable between a closed position and an open position in order to provide access to said electrical switching apparatus, said electrical switching apparatus including a handle, said operating mechanism comprising:

a linkage structured to be coupled to said handle of said electrical switching apparatus and to provide operation of said handle from the exterior of said enclosure when said panel is closed;

an operating member including a first end and a second end, the first end of said operating member having an engaging portion coupled to said linkage of said operating mechanism when said panel is disposed in said closed position and said open position, the second end of said operating member having a handle portion structured for gripping by a user;

wherein when said panel of said enclosure is disposed in said open position and said handle portion of said operating member is actuated, said engaging portion of said operating member moves said linkage thereby operating said handle of said electrical switching apparatus;

wherein said handle portion of the second end of said operating member includes a grip; and wherein said grip comprises a cover made from an electrically insulating material.

14. The operating mechanism of claim 13 wherein said electrically insulating material is vinyl.

* * * * *